US010854178B2

(12) United States Patent
Mayo

(10) Patent No.: US 10,854,178 B2
(45) Date of Patent: Dec. 1, 2020

(54) DUAL PURPOSE PERCUSSION DRUMSTICK

(71) Applicant: Wesley Ray Mayo, Merritt Island, FL (US)

(72) Inventor: Wesley Ray Mayo, Merritt Island, FL (US)

( * ) Notice: Subject to any disclaimer, the term of this patent is extended or adjusted under 35 U.S.C. 154(b) by 0 days.

(21) Appl. No.: 16/865,917

(22) Filed: May 4, 2020

(65) Prior Publication Data

US 2020/0265814 A1 Aug. 20, 2020

Related U.S. Application Data

(63) Continuation of application No. 16/266,792, filed on Feb. 4, 2019.

(60) Provisional application No. 62/709,946, filed on Feb. 5, 2018.

(51) Int. Cl.

| | |
|---|---|
| ***G10D 13/12*** | (2020.01) |
| ***G10D 13/02*** | (2020.01) |
| ***B25G 1/06*** | (2006.01) |

(52) U.S. Cl.

CPC ..... *G10D 13/12* (2020.02); *B25G 1/06* (2013.01); *G10D 13/02* (2013.01)

(58) Field of Classification Search

CPC ..... G10D 13/12; G10D 13/02; B25G 1/06

See application file for complete search history.

(56) References Cited

U.S. PATENT DOCUMENTS

| | | | | |
|---|---|---|---|---|
| 4,200,026 | A | 4/1980 | Phreaner | |
| 4,535,671 | A | 8/1985 | Stromberg et al. | |
| 4,570,527 | A | 2/1986 | Pruitt | |
| 5,370,030 | A | 12/1994 | Horne | |
| 5,728,958 | A | 3/1998 | Vater | |
| 6,069,308 | A * | 5/2000 | Rabb | G10D 13/06 84/422.4 |
| 7,868,237 | B1 | 1/2011 | Quilon | |
| 8,674,204 | B2 | 3/2014 | Rundle | |
| 2004/0231493 | A1 | 11/2004 | Milne et al. | |
| 2008/0168889 | A1 | 7/2008 | Rundle | |
| 2012/0144975 | A1* | 6/2012 | Destocki | G10D 13/12 84/402 |
| 2015/0135933 | A1* | 5/2015 | Rundle | G10D 13/12 84/422.4 |

* cited by examiner

*Primary Examiner* — Kimberly R Lockett

(74) *Attorney, Agent, or Firm* — Joel Douglas

(57) ABSTRACT

The invention relates to a drum stick for a percussion instrument, and, more particularly to dual purpose drumstick percussion instrument.

20 Claims, 6 Drawing Sheets

DUAL PURPOSE PERCUSSION DRUMSTICK

CROSS-REFERENCE TO RELATED APPLICATION

This application claims priority from U.S. Provisional Patent Application No. 62/709,946, filed Feb. 5, 2018, titled Mayo stick, this application claims priority from U.S. patent application Ser. No. 16/266,792, filed Feb. 4, 2019, entitled Mayostick, all of which are hereby incorporated by reference herein for all purposes.

Trademarks used in the disclosure of the invention and the applicants make no claim to any trademarks referenced.

BACKGROUND OF THE INVENTION

1) Field of the Invention

The invention relates to a drum stick for a percussion instrument, and, more particularly to dual purpose drumstick percussion instrument.

2) Description of Related Art

At present, different types of drumstick are available which have particular performance characteristics that are particularly suitable for playing certain types of music such as rock, jazz, orchestral pieces or marching band music, for example Drumsticks are generally constructed as a single homogenous unit with a striking element that is determined by the purpose of musical type for which the drumstick is intended. The striking elements include a variety of drumstick tips of varying shapes and material compositions as well as steel or nylon brush elements, felt beaters or mallets.

Drummers and percussionists who do not specialize in one particular type of music will encounter a variety of musical situations that require an extensive range of drumsticks/beaters. These must be selected from a large range of manufactured items to allow the user to select the drumstick or beater of the user's preference in terms of overall weight, balance, tip type and feel. Manufacturers therefore supply a vast range of drumsticks and beaters, and accordingly distributors attempt to supply this comprehensive range.

One-part solution to this problem has been to provide drumsticks that have interchangeable front stick elements, that is the portion of the stick ahead of the handle which actually comprises the striking element. However, although this allows the drummer to reduce the number of sticks and beaters he carries, he must still carry a number of sticks if he wishes to vary the performance characteristics (e.g. weight, balance and rebound) of the stick.

The issue is compounded when the drummers and percussionist need to use practice drumsticks which do not produce the sound levels so that the noise is modulated. Commonly drummers need to reduce noise and to play quietly such as when practicing at home or in an otherwise noise-sensitive environment, or when playing in a low-volume venue such as a jazz club, for example, traditional drumsticks can be overbearing.

Therefore, what is needed in the art is to provide a drumstick that provides where the same drumstick can be used as a standard drum stick can be used as a brush for use with a cymbal.

Additionally, there is a need in the art to provide a drumstick that provides noise that is modulated thereby reducing the volume when practicing.

BRIEF SUMMARY OF THE INVENTION

The invention in one form is directed to a dual use percussion drumstick that provides a simple method to change the drumstick percussion tip being used during a performance.

The invention in another form provides a drumstick that has a noise that is modulated thereby reducing the volume when practicing.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION

Figure 1:
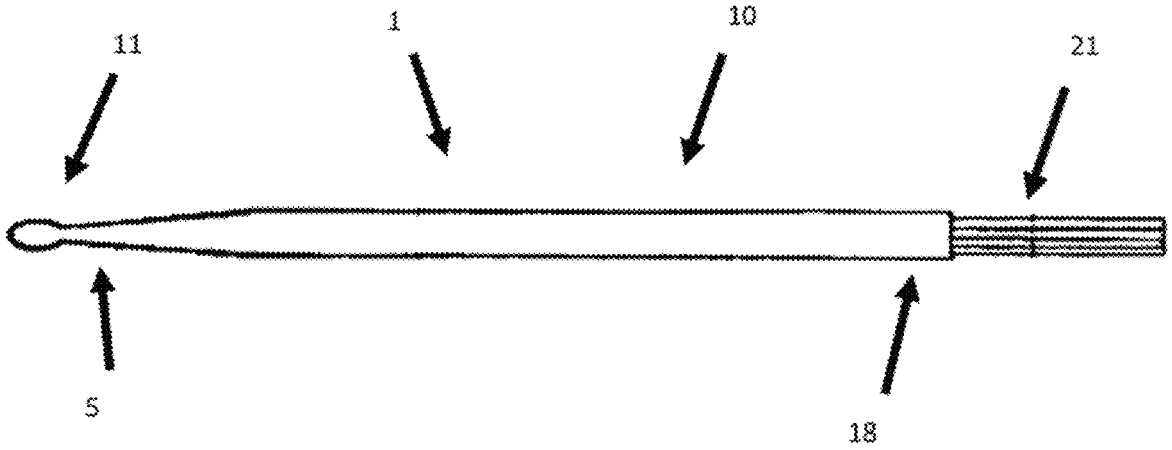
FIG. 1 shows a side view of a solid shaft hard wood drumstick of the invention with a standard percussion stick tip on one end and a bamboo bundle on the opposite end.

In the following description, numerous specific details are set forth. However, it is understood that embodiments of the invention may be practiced without these specific details. In other instances, well-known structures and techniques have not been shown in detail in order not to obscure the understanding of this description. Those of ordinary skill in the art, with the included descriptions, will be able to implement appropriate functionality without undue experimentation.

References in the specification to "one embodiment" or "an embodiment," may indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that such feature, structure, or characteristic may be deployed in connection with other embodiments whether or not explicitly described.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

The terms people, user, drummer, percussionist and individual are used interchangeably to mean an individual who uses the invention.

The term drumstick or beater are used interchangeably in the specification to mean a drumstick.

References in the specification to "one embodiment" or "an embodiment," may indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that such feature, structure, or characteristic may be deployed in connection with other embodiments whether or not explicitly described.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

The prior art does not provide for a percussion drumstick that provides a method to reduce noise and to play quietly such as when practicing at home or in an otherwise noise-sensitive environment, or when playing in a low-volume venue such as a jazz club, for example, traditional drumsticks can be overbearing. Additionally, the prior art does not provide a drumstick that provides a drumstick where the same drumstick can be used as a standard drum stick and can also be used as a brush for use with a cymbal. The prior art includes U.S. Patent publication 20080168889, Publication Date: Jul. 17, 2008; U.S. Patent publication 20040231493, Publication Date: Nov. 25, 2004; U.S. Pat. No. 5,370,030, Issue Date: Dec. 6, 1994; U.S. Pat. No. 4,200,026, Issue Date: Apr. 29, 1980; U.S. Pat. No. 4,535,671, Issue Date: Aug. 20, 1985; U.S. Pat. No. 5,728,958, Issue Date: Mar. 17, 1998; U.S. Pat. No. 7,868,237, Issue Date: Jan. 11, 2011; U.S. Pat. No. 8,674,204, Issue Date: Mar. 18, 2014; U.S. Pat. No. 4,570,527, Issue Date: Feb. 18, 1986; U.S. Pat. No. 10,482,854, Issue Date: Nov. 19, 2019 the contents of which are incorporated by reference in their entirety.

The instant invention provides a better tone time frame with in a song by having the ability to separate the tone factors without the need of full set of percussion drumsticks. Many instances require the drummer to change their style from the sharp tone of a solid stick to a softer brush tone within the beat of the music piece played and the instant invention can do this without having to change sticks allowing no interruptions with the ongoing song. The instant invention as envisioned in FIG. 1-FIG. 6 creates a durable, efficient, multipurpose percussion drumstick.

The configuration of the drumstick allows the user a more efficient way to instantly change the tone, along with technique, and style to fit a piece of music without changing their style of using the drumstick. The dual nature of the instant invention allows the drummer to utilize only one drumstick type and eliminates the need to replace one set of sticks to another if required. If the song tempo and feel changes with the next song all the drummer has to do is flick their wrist to change the percussion end of the stick and the convex shape forming a handle of the shaft allows the drummer to comfortably hold the stick. This creates a more efficient method for the drummer when playing music. The instant invention is capable of enhancing technique and style for a drummer that uses it. The convex shape also allows the drummer to hold the stick and control it thereby allowing the drummer to easily reverse the stick from bundle end to stick end without fear of losing control of the stick. Current sticks without the convex shape of the invention do not provide a secure grip that allows this complex manipulation.

Referring to FIG. 1-FIG. 6 the drumstick 1 of the invention is disclosed comprised of a shaft 10. Shaft 10 can be made from any suitable wood or synthetic material such as carbon fibers, fiberglass, polypropylene, nylon, Polyvinyl chloride (PVC) or Acrylonitrile butadiene styrene (ABS) plastics which have the required degree of stiffness and resilience desired. A critical decision factor for selecting the appropriate wood is the Janka hardness scale. The Janka scale is used to determine the relative hardness of particular domestic or exotic wood species. The Janka test measures the amount of force, usually expressed in pounds force, required to embed a 0.444" steel ball into the wood to half of its diameter. Woods with a higher rating are harder than woods with a lower rating.

Most drumsticks of the prior art use hickory which has a Janka scale value of 1820. Hickory has been found to work for the drumstick of the instant invention however, woods with a greater Janka hardness scale are preferred.

Drumsticks made with any of the following wood provide a drumstick with strong tones and have an attractive look and feel which makes them desirable.

| Janka Value | Wood name |
|---|---|
| 1820 | Hickory |
| 1830 | Zebrawood |
| 1830 | Figured Zebrawood |
| 1860 | Jarrah Burl |
| 1878 | Yellowheart |
| 1900 | Red Palm |
| 1930 | Wenge |
| 1960 | Bolivian Rosewood |
| 1970 | Padauk |
| 1970 | Ziricote |
| 2010 | Bocote |
| 2020 | Black Palm |
| 2140 | Sucupira |
| 2150 | Leopardwood |
| 2160 | Goncalo Alves |
| 2200 | Chechen |
| 2200 | Honduras Rosewood |
| 2200 | Honduras Rosewood Burl |
| 2250 | Chakte Viga |
| 2318 | Spalted Tamarind |
| 2400 | Osage Orange (Argentine) |
| 2400 | Santos Mahogany |
| 2410 | Figured Bubinga |
| 2410 | Quilted Bubinga |
| 2410 | Bubinga |
| 2430 | Cochen Rosewood |
| 2430 | Indian Ebony |

-continued

| Janka Value | Wood name |
|---|---|
| 2440 | E. Indian Rosewood |
| 2480 | Tamboti |
| 2490 | Red Mallee Burl |
| 2490 | Brown Mallee Burl |
| 2500 | Tulipwood |
| 2520 | Purpleheart |
| 2520 | Figured Purpleheart |
| 2532 | Marblewood |
| 2620 | Amazon Rosewood |
| 2690 | Jatoba |
| 2690 | Olivewood |
| 2700 | Granadillo |
| 2760 | Osage Orange (USA) |
| 2900 | Bloodwood |
| 2920 | Yellow Box Burl |
| 2960 | Cocobolo |
| 3000 | Mun Ebony |

However, a preferred wood is purpleheart which provides a drumstick of the invention that has strong tones along with a look that is quite attractive, it has a Janka hardness of 2550 and provides a durable stock for the cavity that holds the bundle made from at least two flexible members. While the above list of hard woods provides a preferred wood to make the stick from it is contemplated that others will suffice as well.

The bundle made from at least two members is preferably made from a natural flexible material such as bamboo due to the flexibility of the material and it provides more flex, durability, and it has a tone that is better than the birch which is traditionally used. However, in some cases birch may be an acceptable flexible member to make the bundle from. However, it is possible to use a material to form the members of the bundle out of such as metals or a synthetic material. The synthetic material can be selected from the any plastic or other synthetic material such as carbon fibers, fiberglass, polypropylene, nylon, Polyvinyl chloride (PVC) or Acrylonitrile butadiene styrene (ABS) plastics which have the required degree of stiffness and resilience desired to form the bundle. The metal bundle members or wires can be selected from the group consisting of stainless steel, copper, brass or aluminum. The individual diameter of the members of the bundle can range from 0.005 inches/0.127 mm to 0.25 inches/6.35 mm.

The diameter of the shaft can be any diameter which permits the percussionist hand to grip it comfortably and it has been found that the size can be selected from 0.4 inches/10 mm to 0.8 inches/20 mm. However, 0.56 inches/14.3 mm diameter is preferable. The length of shaft 10 can be selected from 14 inch/355 mm to 18 inch/457 mm. However, 16 inch/406 mm length is preferable.

Figure 2:
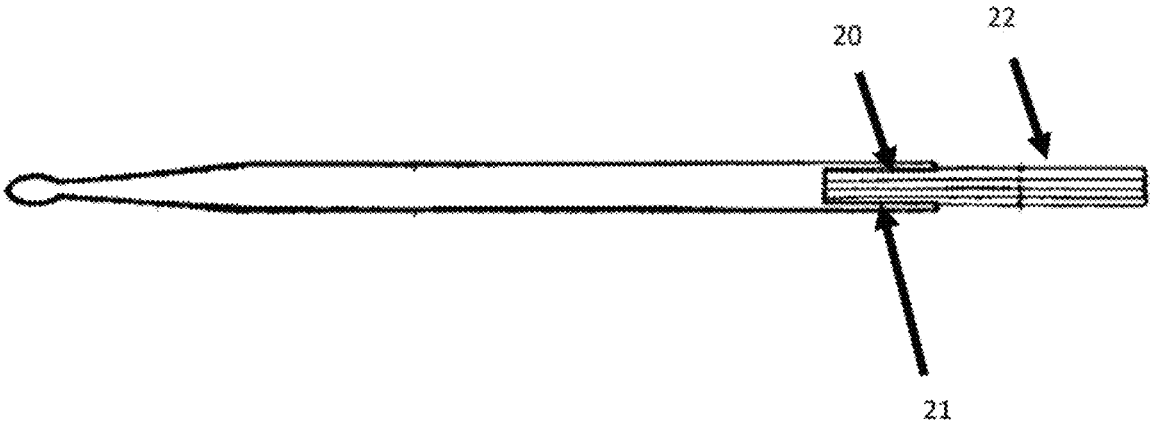
FIG. 2 shows a cross sectional view of the drumstick of FIG. 1 taken lengthwise of along the shaft of the drumstick of the invention with a standard percussion stick tip on one end and a bamboo bundle on the opposite end.

Referring to FIGS. 1 and 2 the shaft 10 extends to end 18 where a hole 20 is drilled in the horizontal plain starting at the end 18 which is distal to the striking or beating end 5 having standard percussion stick tip 11. The end 18 is first cut perpendicular to the shaft 10 prior to drilling hole 20, however, the reverse process could also be employed to form cavity 21. The depth of cavity 21 formed from hole 20 is from 1.2 inches/30 mm to 2 inches/51 mm, the preferred depth is 1.5 inches/38 mm. Further, the stick 10 drumstick includes having the standard percussion stick tip 11 and hole 20 which forms cavity 21. A flexible bundle 22 is inserted in hole 20 such that it is held within cavity 21 and the such that the flexible bundle 22 extends approximately 3 inches/76 mm beyond the end 18 of shaft 10. In the preferred embodiment the flexible bundle is made from bamboo material. The diameter of hole 20 is selected such that the minimum wall thickness of cavity 21 in shaft 10 is 0.062 inches/1.59 mm outer shell of the flexible bundle 22 can be attached to the stick 10 in cavity 21 by an interference fit or by using a suitable adhesive. The adhesive can be selected from either a one-part or two-part epoxy.

The length of the flexible bundle 22 which is preferable made from bamboo is determined by the length of the solid shaft in order to give drumstick the desired final length. The flexible bundle allows the drummer to create different tones that can be created with a striking or beating end 5 or a brush end.

The rigid characteristic of the shaft 10 provides a traditional tactile feel of a drumstick. In addition, it allows traditional drum stick techniques such as 'rim shots' and 'cross sticking' to be accomplished within traditional sound expectations. The bell of the cymbal can also be struck with the standard percussion stick tip 11 or with the bamboo bundle 22.

Figure 3:
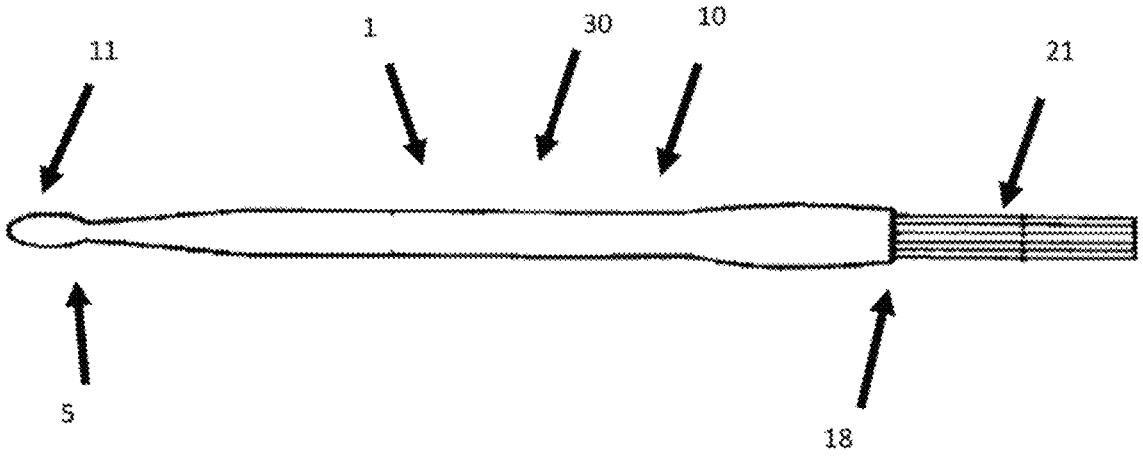
FIG. 3 a side view of a solid shaft hard wood drumstick of the invention with a standard percussion stick tip on one end and a bamboo bundle on the opposite end.
Figure 4:
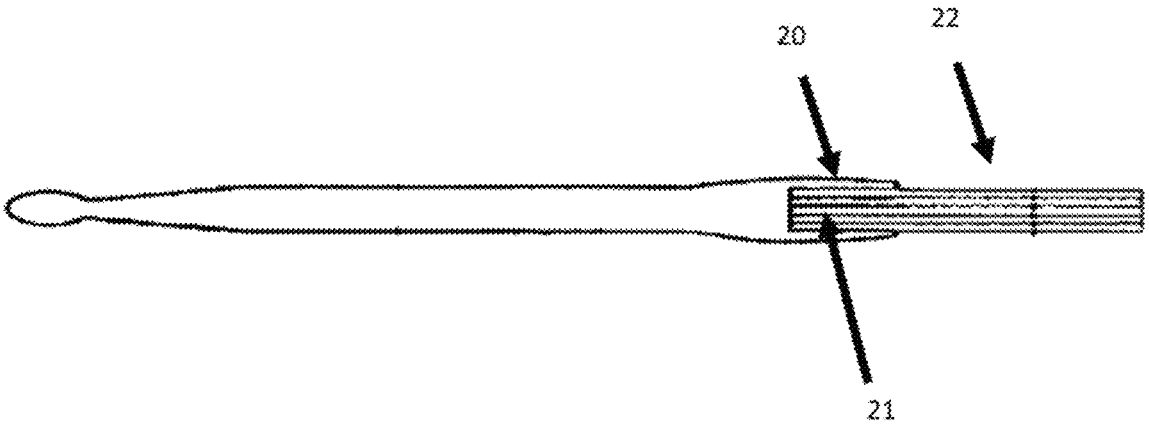
FIG. 4 shows a cross sectional view of the drumstick of FIG. 3 taken lengthwise of along the shaft hard wood drumstick of the invention with a standard percussion stick tip on one end and a bamboo bundle on the opposite end.

Referring to FIGS. 3 and 4 the shaft 10 extends from proximal end 5 to distal end 18 where a hole 20 is drilled in the horizontal plain starting at the end 18 which is distal to the striking or beating end 5 having standard percussion stick tip 11. However, shaft 10 has a convex shape 30. The convex shape 30 which extends outward to a maximum diameter of 0.8 inches/20 mm however a diameter of 0.7 inches/17.43 mm at the center of the convex area, this is for use as a hand placement and forms a handle for a better fulcrum usage to the solid tip end of the stick 10. This also gives a stronger more durable encasement around the flexible bundle 22. The convex shape also provides the drummer a better grip and more control over the stick when reversing the stick from bundle end to stick end.

The benefit of incorporating such feature as the convex shape 30 to the shaft 10 increases the dynamic range available in one drumstick as well as provides an ideal handle for the drummer to hold onto the drumstick.

Figure 5:
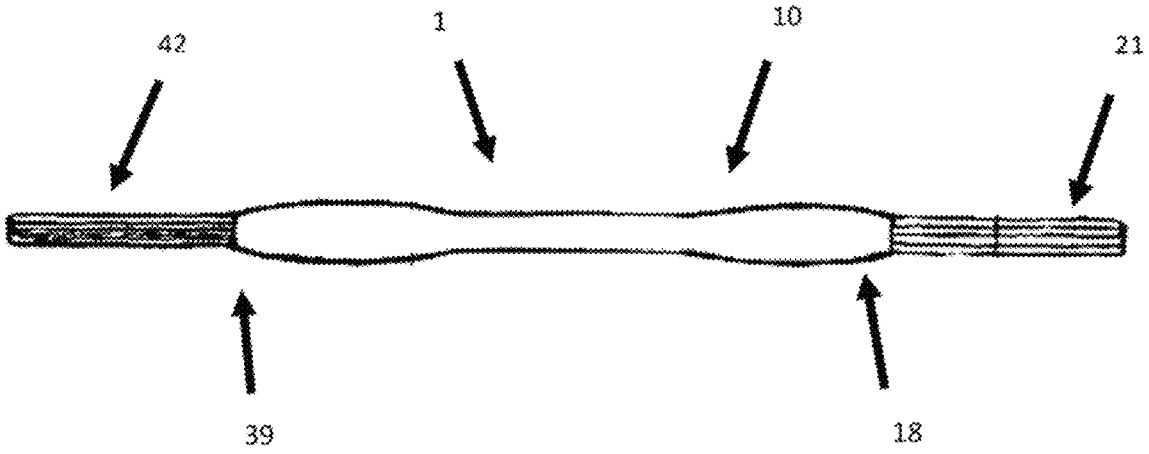
FIG. 5 a side view of a solid shaft hard wood drumstick of the invention with a convex shape forming a handle for handling and strength and two bamboo bundle extending outwards from each end.
Figure 6:
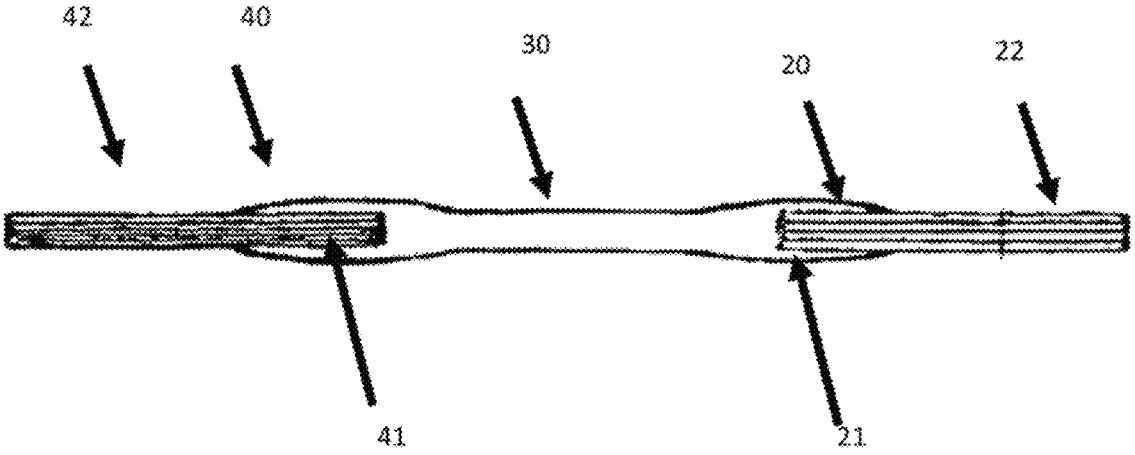
FIG. 6 shows a cross sectional view of the drumstick of FIG. 5 taken lengthwise of along the shaft hard wood drumstick of the invention with a standard percussion stick tip on one end and a bamboo bundle on the opposite end.

Referring to FIGS. 5 and 6 the shaft 10 extends to end 18 where a hole 20 is drilled in the horizontal plain starting at the end 18 which is distal to end 39. Proximal end 39 is constructed similarly to end 18 and it has hole 40 and cavity 41. However, shaft 10 has a convex shape 30. The convex shape 30 which extends outward to a maximum diameter of 0.8 inches/20 mm however a diameter of 0.7 inches/17.43 mm at the center of the convex area, this is for use as a hand placement for a better fulcrum usage to the shaft 10 as well as provides an ideal handle for the drummer to hold onto the drumstick. This also gives a stronger more durable encasement around the bamboo bundle 22 and bamboo bundle 42. The diameter of hole 20 and hole 40 is selected such that the minimum wall thickness of cavity 21 and cavity 41 in shaft 10 is 0.062 inches/1.59 mm outer shell. The flexible bundle 22 and flexible bundle 42 are attached to the stick 10 in cavity 21 and cavity 41 by an interference fit or by using a suitable adhesive. The adhesive can be selected from either a one-part or two-part epoxy. In the preferred embodiment the flexible bundle is made from bamboo material.

Alternatively, the length flexible bundle 22 and flexible bundle 42 can be different lengths and they can be made from different member size or different materials.

A stick with two bundles such as that shown in FIGS. 5 and 6 also allows the bundles to be different which expands the range of the tones available to the drummer and composer. For example, one bundle could be shorter than the other and therefore provide a different tone or the diameters of the members making up the bundle can be different which can also change the tone when the drumstick is used on a drum, cymbal or other percussion instrument. Also, the material that makes up the bundles could be different such as one side plastic and the opposite side bamboo. This changes the available tones and sounds of the instrument. This flexibility expands the range of tones available to the drummer and the composer.

Additionally, the benefit of incorporating such features of the convex shape 30 to the shaft 10 increases the dynamic range available in one drumstick and it provides an ideal handle for the drummer to hold onto the drumstick.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A drumstick comprising of a solid shaft wherein said shaft has at least one cavity at the distal end and one striking end on the proximal end and said solid shaft has a convex shape forming a handle and said convex shape is located between said striking end and said cavity and said convex shape having a center of the convex area and a flexible bundle made from flexible material is inserted in said cavity and said bundle attached to said cavity with an adhesive.

2. The drumstick solid shaft of claim 1 formed from wood.

3. The wood of claim 2 selected from the group of hardwoods having a Janka hardness value of 1820 to 3000.

4. The drumstick solid shaft of claim 1 being made from Purpleheart wood.

5. The drumstick solid shaft of claim 1 formed from syntactic material selected from the group consisting of carbon fibers, fiberglass, polypropylene, nylon, Polyvinyl chloride and Acrylonitrile butadiene styrene.

6. The drumstick of claim 1 wherein the flexible bundle is formed from a natural material selected from the group consisting of bamboo and birch.

7. The drumstick of claim 1 wherein the flexible bundle is formed from a metal wire or a synthetic material.

8. The metal wire of claim 7 selected from the group consisting of stainless steel, copper, brass and aluminum.

9. The synthetic material of claim 7 selected from the group consisting of as carbon fibers, fiberglass, polypropylene, nylon, Polyvinyl chloride and Acrylonitrile butadiene styrene.

10. The flexible material forming said bundle of claim 1 having an individual diameter selected from 0.005 inches/0.127 mm to 0.25 inches/6.35 mm.

11. A drumstick comprising of a solid shaft wherein said shaft has a first cavity at the distal end and second cavity on the proximal end and said sold shaft has a convex shape forming a handle and said convex shape is located between said first cavity and said second cavity and said convex shape having a center of the convex area and a first flexible bundle made from flexible material and a second flexible bundle made from flexible material and said first flexible bundle is inserted in said first cavity and said first bundle of flexible material is attached to said first cavity with an adhesive and said second bundle of flexible material is inserted in said second cavity and said second bundle of flexible material is attached to said second cavity with an adhesive.

12. The drumstick solid shaft of claim 11 formed from wood.

13. The wood of claim 12 selected from the group of hardwoods having a Janka hardness value of 1820 to 3000.

14. The drumstick of claim 11 being made from Purpleheart wood.

15. The drumstick solid shaft of claim 11 formed from syntactic material selected from the group consisting of carbon fibers, fiberglass, polypropylene, nylon, Polyvinyl chloride and Acrylonitrile butadiene styrene.

16. The drumstick of claim 11 wherein the flexible bundle is formed a natural material selected from the group consisting of bamboo and birch.

17. The drumstick of claim 11 wherein the flexible bundle is formed a metal sire or a synthetic material.

18. The metal wire of claim 17 selected from the group consisting of stainless steel, copper, brass and aluminum.

19. The synthetic material of claim 17 selected from the group consisting of carbon fibers, fiberglass, polypropylene, nylon, Polyvinyl chloride and Acrylonitrile butadiene styrene.

20. The flexible material forming said bundle of claim 11 having an individual diameter selected from 0.005 inches 0.127 mm to 0.25 inches 6.35 mm.

* * * * *